United States Patent [19]

Okazaki et al.

[11] 4,267,016

[45] May 12, 1981

[54] POLYVINYL ALCOHOL FIBER FOR BINDING A FIBROUS SHEET AND A PROCESS FOR THE PREPARATION THEREOF

[76] Inventors: Masaki Okazaki, 4-20-(14-405) Fukushima; Akio Mizobe, 2-6-19 Fukushima, both of Okayama-City, Okayama Prefecture, Japan

[21] Appl. No.: 87,347

[22] Filed: Oct. 23, 1979

[30] Foreign Application Priority Data

Oct. 23, 1978 [JP] Japan ..... 53-130764
Oct. 26, 1978 [JP] Japan ..... 53-132435

[51] Int. Cl.[3] ..... D21H 5/12
[52] U.S. Cl. ..... 162/146; 162/157 R
[58] Field of Search ..... 162/146, 157 R, 164 R, 162/164 EP; 264/185, 205; 525/58, 61; 428/364, 296, 288

[56] References Cited

U.S. PATENT DOCUMENTS 3,028,296 4/1962 Adams et al. ..... 162/146
3,114,670 12/1963 Iwasaki ..... 162/146

*Primary Examiner*—Peter Chin
*Attorney, Agent, or Firm*—Barry Kramer

[57] ABSTRACT

A water-soluble polyvinyl alcohol fiber is obtained by subjecting to the conventional dry or wet spinning process, a solution prepared by adding to a polyvinyl alcohol aqueous solution, an adduct composed of a polyamide condensation product and 1-halogen-2,3-epoxy propane or ethylene glycol diglycidyl ether in the range from 5 to 50 percent by weight based upon the polyvinyl alcohol-after the solution's pH has been adjusted to 2 to 7. The resulting fiber, which has not been subjected to any heat treatment at a temperature above 120° C. is blended with a fibrous material to make a fibrous sheet such as paper or non-woven fabric. By virtue of a subsequent heat-treatment, said polyvinyl alcohol fiber becomes boiling water-resistant; as a result, the wet strength of the fibrous sheet is significantly increased.

10 Claims, No Drawings

POLYVINYL ALCOHOL FIBER FOR BINDING A FIBROUS SHEET AND A PROCESS FOR THE PREPARATION THEREOF

This invention relates to a polyvinyl alcohol (PVA) fiber for binding a fibrous sheet such as paper or non-woven fabric. More specifically, this invention relates to a PVA fiber for the foregoing use and a process for the preparation thereof, which is able to convert the resulting PVA fiber into a boiling water-resistant fiber through heat-treatment after blending with a sheet composed of fibrous material such as paper or non-woven fabric.

It has heretofore been disclosed in Japanese Patent Publication No. Sho 45-31690, that a cationic agent incorporated with pulp in the beating process has the effect of increasing the wet paper strength of the resulting product by forming polymeric cross-links as opposed to hydrogen bonding.

However, the cationic agent has not been employed for the same purpose when hydrophobic fibers, PVA fibers, regenerated fibers, or inorganic fibers are utilized in sheet-making, because these fibers are substantially non-polar materials. Briefly, these fibers, per se, are not suitable for sheet-making. Even if such sheets could be formed, they are not suitable for use due to their poor strength properties. To solve the problem, sometimes a hydrophilic polymer such as PVA has been employed because of its excellent hygroscopicity and its ability to convert itself into a binder spreading over the fibers upon drying. Sometimes pulp has been blended with such fibers to effect binding of entangled points among fibers and to increase the strength thereof. In these cases, the wet strength of papers or non-woven fabrics is exclusively affected by the wet strength of the PVA or pulp blended therewith; therefore, PVA or pulp have to be made water-resistant in order to enhance the wet strength as a whole. However, to date, no effective method for making PVA fibers or pulp water-resistant has been developed. Certainly, it would be expected that acetalization reactions by the use of formaldehyde or acetoaldehyde could be employed in order to convert the water-soluble PVA fibers into a water-insoluble form. Yet, if this method is applied to a blended sheet composed of PVA fibers and hydrophilic fibers, the whole sheet must be treated in the acetalization bath; as a result, significant inconvenience will arise so that the method will never be employed. When the cationic agent is incorporated with pulp-blended materials to increase the wet strength, the cationic agent, being absorbed into pulp, is not only quite useless to enhance the wet strength of fibers such as hydrophobic synthetic fibers, PVA-based synthetic fibers, regenerated fibers, and inorganic fibers, but also is eventually wastefully removed. Moreover, in the case of pulp-blending, a component fiber tends to lose its favorable properties. In order to avoid such drawbacks, generally a fibrous sheet blended with the conventional PVA fiber is coated with a resinous material or laminated with a polymer film in order to impart boiling water resistance. But according to this method, another problem occurs; namely, the sheeted material must be treated again by a wet process such as the coating process including subsequent drying and heat-treatment; besides, measures against environmental pollution, energy loss, and quality control have to be strictly employed in such processes.

Ideally, in making papers or non-woven fabrics, if a PVA fiber could be blended in the same way as the conventional PVA binding fibers can and if the fibrous sheet blended with the PVA fiber then could be subjected to an insolubilization process, the PVA fiber would produce papers or non-woven fabrics exhibiting excellent wet strength.

The present inventors have made an intensive effort to produce such PVA binding fiber, and have found a stable spinning process which does not cause separation of components in PVA solution and also an excellent insolubilizing agent for PVA, which insolubilizing effect is produced upon heat-treatment.

The addition of a cross-linking agent has been widely used to make PVA water-insolubilized. In Japanese Patent laid-Open No. Sho 53-110647, for instance, epichlorohydrin has been disclosed as a cross-linking agent. But when epichlorohydrin is used, a poisonous substance forms during reaction, and the PVA is stained.

Accordingly, the papers so produced become poisonous, and the commercial value is decreased due to the staining. From such point of view, the present invention aims at providing non-poisonous and unstainable PVA fibers, which enables papers or non-woven fabrics to bind together closely after the heat-treatment for insolubilization, and a production process therefore. In short, the PVA binding fiber of the present invention having the latent ability of developing boiling water-resistance can be obtained from the conventional wet or dry spinning of a solution prepared by adding to a 5 to 70 percent by weight of PVA aqueous solution, an adduct composed of a polyamide condensation product and a 1-halogen-2,3-epoxy propane or ethylene glycol diglycidyl ether in the range of from 5 to 50 percent by weight based upon the weight of PVA, after the solution pH has been adjusted to 2 to 7.

The fundamental requirement for smoothly carrying out the spinning of the mixed solution consists in good inter-solubility between the PVA aqueous solution and an insolubilizing agent for PVA, stable viscosity and thermo-chemical stability of the mixed solution. Cationized urea resin and melamine resin are water-soluble and known as insolubilizing agents for PVA, but they cannot be used in this spinning process since they form an unstable spinning solution.

Among the substances to be added as an insolubilizing agent for PVA are the adduct of a polyamide condensation product and a 1-halogen-2,3-epoxy-propane such as water-soluble cationic polyamide polyamine-1-halogen-2,3-epoxypropane, polyamide-1-halogen-2,3-epoxypropane, polyamide polyamine polyester polyether-1-halogen-2,3-epoxypropane and adducts of any of the foregoing condensation products with ethyleneglycol diglycidyl ether. The halogenated epoxy-propanes include the chlorinated, brominated, iodinated and fluorinated derivatives. The quantitative proportion of the insolubilizing agent to the PVA in the aqueous solution is preferably between 5 and 50 percent by weight, more preferably between 20 and 30 percent by weight. If the foregoing quantitative proportion is less than 5 percent by weight, the insolubilizing effect after heat-treatment becomes lower than has been anticipated; conversely, when the proportion is more than 50 percent by weight, good spinnability cannot be achieved.

The degree of saponification of the PVA is preferably between 80 and 100 mole percent, more preferably between 90 and 100 mole percent. The degree of polymerization of the PVA is generally in the range of from 300 to 3000, and preferably within the range of from 1500 to 2000. The PVA thus specified is dissolved in water to make up a 5 to 70 percent by weight PVA aqueous solution to which the foregoing insolubilizing agent is added. It is necessary for the solution pH to be adjusted to 2 to 7 when the insolubilizing agent is added. When the pH is below 2, corrosion tends to take place in the equipment, which is unfavorable for practical operations. Conversely, when the pH is above 7, hydrolysis of the insolubilizing agent occurs, which reduces the insolubility of the PVA, even if the heat-treatment is carried out. When the pH is higher than this level, that is, as the alkalinity becomes strong, this causes staining in PVA, and lowers the product value.

The mixture of PVA and the insolubilizing agent can be preserved as a stable solution without causing gelation or viscosity increase for 16 to 72 hours by maintaining the solution at 80° to 95° C. In the wet spinning process, this solution is further made up to 10 to 25 percent PVA by weight of solution which serves as the spinning solution to be extruded from orifices into the spinning bath containing saturated Glauber's salt to coagulate and to form fibers according to the conventional spinning process. The PVA fibers thus formed are led to the bath at a higher temperature, where they are stretched in an appropriate drawing ratio. The stretched PVA fibers are then dried, and, if necessary, they are stretched again and lightly heat-treated at a temperature below 120° C. When stretching is carried out after drying, the fibers are additionally stretched within an amount such that the total drawing ratio does not exceed 5 to 12 times in order that the dissolving temperature might be present between 45° and 95° C. The heat-treatment may be conducted to get the fibers shrunk in order to give them dimensional stability. In the dry spinning process, the concentration of the PVA spinning solution ranges from 25 to 70 percent PVA by weight of solution, and preferably ranges from 30 to 45 percent PVA by weight of solution. The spinning is carried out according to the conventional process by extruding the solution from orifices into the air to evaporate moisture and to form fibers. The fibers can be used as the binding fibers of this invention, yet sometimes they are drawn 8 to 12 times in total, then lightly heat-treated.

Regardless of whether the spinning process employed is the wet or the dry process, it is necessary for the PVA raw yarn not to be exposed to the temperature above 125° C., for reaction tends to progress in the yarn at a higher temperature. Of course, this cannot be generalized unless the heating time is taken into consideration. The PVA fibers formed by the wet spinning process must undergo the drying process. In this case, drying must be carried out at a lower temperature extending for a longer period. For this purpose, a dryer of the hot flue type is recommended. But with a dryer of the radiant heat type, the heat-treatment may also be conducted if only the temperature distribution is well controlled not to get uneven. When the insolubilizing agent is added in high concentration, the fibers should not be dried after spinning; but instead should be dehydrolyzed, and taken in a box as it is. The PVA binding fibers for sheet-making is obtained by cutting the raw yarn thus produced.

The PVA binding fibers, slightly swelling, can be well dispersed in water as the conventional PVA fibers can. Paper-making is possible using this PVA fiber dispersion. Among fibers with which the PVA binding fibers can be blended are wood fibers such as ground pulp, kraft pulp, semi-chemical pulp, sulphite pulp, soda pulp, chemi-ground pulp and the like, vegetable fibers such as cotton, manila hemp, jute, broussonetia kazinoki, edgeworthia papyrifera, wiketroemia sikokiana and the like, hydrophobic synthetic fibers such as polyester, polyacrylonitrile, polyolefin, polyvinyl chloride, polyamide, and the like, regenerated fibers such as hydrophilic PVA synthetic fiber, viscose rayon filament, viscose rayon staple fiber, acetate fiber and the like, inorganic fibers such as glass fiber, asbestos fiber, carbon fiber and the like, and admixtures of any of such fibers. A requirement for the PVA binding fiber is to melt and closely bind fibers to fibers at their crossing points when papers wetted therewith enter into a dryer. To make sure, the dissolving temperature of the PVA fibers must be determined in water. The dissolving temperature is much influenced by the degree of saponification, the degree of polymerization, the additives' concentration, the drawing ratio in the spinning bath and in water, and the manner of drying, drawing, and heat-treating. However, the dissolving temperature is preferred to lie between 45° and 105° C. When the dissolving temperature is below this range, the PVA binding fiber swells and dissolves in water, and this will cause a decrease of the binder's amount actually effective for use, a decrease in paper strength, and will adversely affect sheet formation. Conversely, when the dissolving temperature is too high exceeding this range, the PVA fibers do not melt on the dryer's surface; as a result, the PVA fibers cannot act as a binder in sheet formation, and the resulting paper strength becomes very much decreased.

From this reason, the dissolving temperature of the PVA fiber is preferably between 45° and 95° C., and most preferably between 60° and 95° C. The dissolving temperature is determined by measuring the temperature of water being raised from room tempterature at the rate of 3° C. per minute, at which a single PVA fiber of this invention hung with a 1/500 load of the dinier number of said single fiber is broken in the water.

The amount of the PVA binding fiber to be added to paper stock is varied with the kind of paper stock fiber, but is generally preferred to be in the range from 2 to 30 percent by weight. When the amount is less than 2 percent by weight, the insolubilizing effect does not become apparently demonstrated after heat-treatment because the binding force is too small. On the other hand, when the amount is more than 30 percent by weight, finished papers become stiff and the binding force is not meaningfully increased. Accordingly, the amount of the PVA binding fiber to give a good result generally ranges between 3 and 25 percent by weight. A sheet can be produced according to the conventional wet process from a slurry composed of paper stock fibers and the PVA binding fibers, and raw papers can be obtained in the form of sheets such as papers or non-woven fibrics. Such raw sheets are then subjected to the heat-treatment by means of dryers such as the heat-radiating arch type, hot flue type or hot roller-touching type. The insolubilization takes place in the PVA binding fibers by heat-treatment. Papers are preferred to be heated above 120° C., more disirably above 125° C., for 1 to 120 seconds. The time and the temperature should be varied with the kind of paper stock fibers, the thickness of raw papers, and the systems of heat-treatment. But when the temperature is below 120°

C., the thermosetting reaction of the insolubilizing agent diminishes with results which do not differ significantly from that of the conventional PVA binding fibers. When the temperature exceeds 220° C., thermal decomposition commences, which will cause staining of the PVA so that the treatment becomes unable to be carried out above this temperature. The sheets and papers thus obtained maintain good shape retention even after being immersed into 100° C. boiling water. Besides, the wet strength, after boiling, is still more than 20 percent compared with the dry strength, which demonstrates one of the characteristic features of this invention.

Table 1 presents a detailed explanation of these results. An amount of PVA with a degree of saponification of 99.99 mole percent and a degree of polymerization of 1680 was added to water. An amount of Polyfix 301 (the tradename of polyamide-1-chloro-2,3-epoxypropane produced by Showa Highpolymer Co., Ltd.) was added to the foregoing solution to make up a 16 percent by weight PVA solution. After the solution's pH was adjusted to 6.0, this solution was spun in a wet spinning process using saturated Glauber's salt for the coagulating bath. The PVA raw yarn thus obtained is then dried.

A raw yarn composed of 1.0 denier single filaments thus obtained was heat-treated in a dryer for 30 seconds at 100°, 120°, 150°, 170°, 200°, and 230° C. respectively, while the raw yarn was fixed so as not to suffer a diminsional change. The optimal range of the additives concentration and the heat-treatment temperature could be determined by investigating the shape and the swelling degree by weight of the fibers that were prepared by soaking the foregoing heat-treated fibers in 100° C. boiling water for 5 minutes.

to remove any excess water adhered by means of filter papers.

As shown in Table 1, the spinnability is good below 20 percent by weight of the insolubilizing agent, but it becomes unstable around 50 percent by weight, and finally loses operationability at 60 percent by weight. Concerning the quantity of the insolubilizing agent, the insolubilizing function is still very little below 5 percent by weight. As for the heat treatment temperature, the insolubilization is still insufficient below 100° C. so that the PVA binding fiber treated below 100° C. gets to be dissolved in the boiling water. At 120° C., the insolubilization becomes effective but the PVA fiber still greatly swells. As the heat-treatment temperature increases such as 150°, 180°, and B 200° C., the insolubilization becomes better. However, when the PVA fiber is treated at 230° C., the insolubilization is further improved, but staining occurs, and this presents another problem. Such is the result of the test as to the PVA fiber, but a similar conclusion is derived when the fiber is treated on papers or non-woven fabrics with which it is blended.

Epichlorohydrin, i.e. 1-chloro-2,3-epoxy propane, one of the insolubilizing agents for the PVA fiber, can be used singly, not in combination with a polyamide condensation substance, but epichlorohydrin seems practically unsuitable due to the following reason. A 16 percent by weight PVA aqueous solution containing 20 percent by weight of epichlorohydrin on the basis of the weight of PVA was allowed to stand in the air at 90° C. for 16 hours. This solution did not show decomposition or staining; moreover, it was stable enough to preclude separation of the ingredients, and can be subjected to wet spinning. However, the filaments had an epichlorohydrin smell after drying at 120° C. for 5 minutes, so

TABLE 1

| | | 1. | 100° | | 120° | | 150° | | 180° | | 200° | | 230° | |
|---|---|---|---|---|---|---|---|---|---|---|---|---|---|---|
| 4. | 3. | 2. | State | S | State | S | State | S | State | S | State | S | State | S |
| 0 | Good | | Dissolving | — | Dissolving | — | Dissolving | — | Dissolving | — | Dissolving | — | Dissolving Staining | — |
| 3 | Good | | Dissolving | — | Dissolving Swelling | — | Dissolving | — | Dissolving | — | Dissolving | — | Dissolving Staining | 4.6 |
| 5 | Good | | Dissolving | — | Remarkably swelling | 5.3 | Swelling | 5.0 | Swelling | 4.5 | Swelling | 4.0 | Swelling Staining | 3.7 |
| 10 | Good | | Dissolving | — | Remarkably swelling | 4.8 | Swelling | 4.6 | Swelling | 3.8 | Swelling | 3.4 | Swelling Staining | 3.2 |
| 20 | Good | | Dissolving | — | Remarkably swelling | 4.1 | Swelling | 4.0 | Swelling | 3.3 | Swelling | 2.8 | Swelling Staining | 2.8 |
| 50 | Unstable | | Dissolving | — | Swelling | 3.2 | Swelling | 3.0 | Swelling | 2.4 | Swelling | 2.1 | Swelling Staining | 2.3 |
| 60 | Bad | | Dissolving | — | Swelling | 3.0 | Swelling | 2.9 | Swelling | 2.3 | Swelling Staining | 2.0 | Swelling Staining | 1.9 |

1.Heat-treatment temp. (°C.)
2.Retention of the original form
3.Spinnability
4.Amount of the additive (Wt. %/PVA)

In Table 1, what is described as "state" shows the morphological results 5 minutes after the PVA binding fiber is put into water at 100° C. The swelling degree by weight (S) indicates the quantitative ratio of the 5-minute-boiled fiber to the absolutely dried fiber; the 5-minute-boiled fiber taken out from water being wiped that the atmosphere proved to be polluted. The PVA fiber including epichlorohydrin could be insolubilized, in a way, but the fiber turned brown and smoked emitting the epichlorohydrin smell when it was heat-treated (see Table 2). Since the gas is strongly poisonous, it seems unsuitable for such PVA fiber to be put into industrial use.

TABLE 2

| Results of the heat-treatment of the epichlorohydrin added PVA binding fiber | | | |
|---|---|---|---|
| Sample and its history | Appearance | Change after soaking into water at 100° C. for 5 min. | Change when soaked in ethylene diamine |
| Wet-spun, and dried yarn | transparent | dissolves when put in | dissolves |

TABLE 2-continued

| Sample and its history | Results of the heat-treatment of the epichlorohydrin added PVA binding fiber | Appearance | Change after soaking into water at 100° C. for 5 min. | Change when soaked in ethylene diamine |
|---|---|---|---|---|
| Heat-treated Yarn | hot-flue, 170° C. × 10 min. | brown | swells and dissolves | dissolves or greatly swells |
| | hot-flue, 190° C. × 10 min. | brown | insoluble | dissolves or greatly swells |
| | hot roller 210° C. × 30 sec. | brown | insoluble | dissolves or greatly swells |

The PVA insolubilizing agent used in the invention is an agent for fortifying the wet strength of a paper composed of wood fibers or vegetable fibers, as is known. Usually, these polymeric substances are mixed with wood fibers or vegetable fibers in the beating process and are thus absorbed into the fibers. (see U.S. Pat. No. 2,926,116). But according to this method, retention of these substances is low and very little effect is obtained in increasing the wet strength; besides, this kind of reinforcing material has not been used when the paper stock fiber is a non-polar substance. On the contrary, according to the present invention, blending the insolubilizing agent with PVA has greatly improved the retention of the polymer and provides a boiling water resistant paper having excellent dry and wet strength by virtue of the heat-treatment. Furthermore, the blending process has made it possible to use any kind of fiber for the paper stock, regardless of whether they are hydrophilic or hydrophobic. These advantages are naturally to be counted as the characteristic features of this invention.

The preferred embodiment of this invention will be further explained in detail in accordance with the examples as follows.

EXAMPLE 1

PVA having a degree of polymerization of 1700 and a degree of saponification of 99.9 mole percent was dissolved in water and the pH was adjusted to 6.8. Polyfix 301 (the trade name of water-soluble cationic polyamide-1-chloro-2,3-epoxy propane resin produced by Showa Highpolymer Co., Ltd.) was added to the PVA solution in order for the amount of Polyfix 301 to be 20 percent by weight on the basis of the weight of PVA, then the mixture was prepared with stirring to make up the PVA concentration to 16 percent by weight. separation of components did not occur in the blending. The mixtures pH was adjusted again using sulfuric acid. Despite keeping the mixture (viscosity: 18 poise) standing in a thermostat at 90° C. for 16 hours, there did not occur any viscosity change, gelation, or staining. The pH adjusted to 6.0 did not change either. While keeping the temperature of tanks and pipings at 90° C., wet spinning was carried out using the above mixture under the following conditions: coagulating bath, saturated Glauber's salt solution; draft, 3–5 times (in Glauber's salt solution at 80° C.). After drying at 120° C. for 5 minutes by the use of a heat-radiating type dryer, the fineness of the single filament proved to be one denier and the moisture content was 1.8 percent. The PVA binding fiber was obtained by cutting the filament 3 mm long. Because the dissolving temperature was 85° C., the fiber proved to be available for binding papers. Vinylon (General name for polyvinyl alcohol fiber in Japan. The polyvinyl alcohol fiber is commonly subjected to the acetalization reaction in order to improve the water-insolubility after drawing the heat-treatment.) was used as a paper stock fiber being cut to 5 mm length. The Vinylon fiber employed in this Example was the product of Kuraray Co., Ltd. available on the market under the name VPB 103×5, of which fineness and degree of acetalization were 1.0 denier per a single fiber and a 38 mole percent, respectively. The fiber mixture composed of 20 percent by weight of the PVA binding fiber and 80 percent by weight of the Vinylon paper stock fiber was shaped into a sheet using a papermaking machine with inclined wires. Then, the sheet was dried by a Yankee type dryer at 120° C., taken up on a roll, and heat-treated at 205° C. for 30 seconds being touched to a hot roll.

A control sheet, with the PVA binding fiber containing no insolubilizing agent, was made under the same conditions as described above by mixing the PVA binding fiber with the Vinylon fiber in the proportion of 20 to 80 percent by weight.

The physical properties of these two sheets are summarized in Table 3.

TABLE 3

| | Physical properties prior to the heat-treatment | | | | | | | | | | | | | | | |
|---|---|---|---|---|---|---|---|---|---|---|---|---|---|---|---|---|
| | | | | Dried | | | | After soaking in water at 20° C. for 16 hours | | | | After boiling in water at 100° C. for 5 minutes | | | | |
| | | | | Strength (kg/15mm width) | | Elongation (%) | | Strength (kg/15mm width) | | Elongation (%) | | Strength (kg/15mm width) | | Elongation (%) | | |
| | Weight per unit area ($g/m^2$) | Thickness (mm) | Density ($g/cm^3$) | Longitudinal direction | Lateral direction | Longitudinal direction | Lateral direction | Longitudinal direction | Lateral direction | Longitudinal direction | Lateral direction | Longitudinal direction | Lateral direction | Longitudinal direction | Lateral direction | |
| Sheet for this invention | 58.1 | 0.142 | 0.409 | 10.38 | 7.21 | 11.9 | 10.8 | 3.19 (31.0) | 2.37 (32.9) | 9.7 (81.5) | 8.8 (81.5) | Dissolved in water, no shape remained | | | | |
| Sheet for comparative example | 51.7 | 0.146 | 0.354 | 9.71 | 6.45 | 10.7 | 10.1 | 3.01 (31.0) | 2.15 (33.0) | 10.0 (93.5) | 8.7 (86.0) | Dissolved in water, no shape remained | | | | |

| | Physical properties subsequent to the heat-treatment at 205° C. for 35 seconds | | | | | | | | | | | | | | | |
|---|---|---|---|---|---|---|---|---|---|---|---|---|---|---|---|---|
| | | | | Dried | | | | After soaking in water at 20° C. for 16 hours | | | | After boiling in water at 100° C. for 5 minutes | | | | |
| | | | | Strength (kg/15mm width) | | Elongation (%) | | Strength (kg/15mm width) | | Elongation (%) | | Strength (kg/15mm width) | | Elongation (%) | | |
| | Weight per unit area ($g/m^2$) | Thickness (mm) | Density ($g/cm^3$) | Longitudinal direction | Lateral direction | Longitudinal direction | Lateral direction | Longitudinal direction | Lateral direction | Longitudinal direction | Lateral direction | Longitudinal direction | Lateral direction | Longitudinal direction | Lateral direction | |
| Sheet of this invention | 54.4 | 0.142 | 0.383 | 10.21 | 6.98 | 12.9 | 13.2 | 4.92 (48.2) | 2.95 (42.3) | 13.3 (103) | 12.5 (95) | 3.65 (35.8) | 2.01 (28.8) | 12.2 (95) | 11.0 (83) | |
| Sheet for comparative example | 52.5 | 0.153 | 0.343 | 8.42 | 6.58 | 11.5 | 11.7 | 3.74 (44.4) | 2.52 (38.3) | 11.1 (96.5) | 10.9 (93) | Dissolved in water, no shape remained | | | | |

Numerals in brackets show the percentage of the wet to the dry strength or elongation.

As shown in Table 3, the Vinylon sheets prior to the heat-treatment both were dissolved in boiling water regardless of whether the PVA binding fiber contains the insolubilizing agent or not. However, after heat-treatment, the Vinylon sheet with which the PVA binding fiber of this invention was blended had a high wet strength, and withstood boiling in water at 100° C. for 5 minutes, while the control Vinylon sheet with the PVA binding fiber containing no insolubilizing agent could not bear boiling and dissolved out in water.

EXAMPLE 2

The 3 mm PVA binding fiber used in Example 1 was blended with a paper stock fiber which was made by heating unbeaten, bleached kraft pulp to the 700 ml Canadian standard freeness with an Ohken type laboratory beater (manufactured by Toyo Seiki Co., Ltd.), in the ratio 1 to 9. For paper-making, TAPPI's square-shaped standard paper-making machine was used and drying was carried out by means of a drum type dryer. The heat-treatment was made by touching this paper stock to the hot roll at 200° C. for 20 seconds. Separately, the same PVA binding fiber was blended with paper stock fiber, made by beating unbleached manila hemp to the 650 ml Canadian standard freeness with an Ohken type laboratory beater, in the ratio of 1 to 9. Paper-making and heat-treatment were carried out in the same way as described above. In addition to these, another PVA binding fiber which did not contain the insolubilizing agent was blended with the above two kinds of paper stock fibers in the proportion of 1 to 9 similarly. The conditions of paper-making and heat-treatment were the same as mentioned above. The results are shown in Table 4. The tensile strength was measured according to the procedure of JIS-P8113.

As clearly shown in Table 4, there is almost no difference in the wet strength at 20° C. between the two kinds of paper sheets. However, by virtue of heat-treatment, the paper sheet according to the present invention provides wet strength as much as 30 to 34 percent compared with the dry strength even after soaking in water at 100° C. for 5 minutes. Therefore, the difference between the two PVA binding fibers becomes obvious.

TABLE 4

| | Component | | Weight per unit area ($g/m^2$) | Physical properties prior to the heat-treatment | | | | | | |
|---|---|---|---|---|---|---|---|---|---|---|
| | | | | Dried (D) | | After soaking in water at 20° C. for 16 hours W1 | | After boiling in water at 100° C. for 5 minutes (W2) | | |
| | Paper stock fiber | PVA binding fiber | | Strength (kg/15mm width) | Elongation (%) | Strength (kg/15mm width) | Elongation (%) | Strength (kg/15mm width) | Elongation (%) | Retention of paper shape |
| Sheet of this invention | Kraft Pulp | Containing insolubilizing agent | 50.3 | 4.50 | 2.9 | 1.30 | 9.4 | — | — | Dissolved without shape |
| Sheet for comparative example | Kraft pulp | Not containing insolubilizing agent | 50.5 | 4.36 | 3.0 | 1.14 | 10.0 | — | — | Dissolved without shape |
| Sheet of this invention | Manila hemp | containing insolubilizing agent | 13.7 | 0.32 | 1.9 | 0.02 | 2.5 | 0.01 | 6.0 | Dissolved remaining some shape |
| Sheet for comparative example | Manila hemp | Not containing insolubilizing agent | 13.5 | 0.30 | 1.8 | 0.02 | 2.3 | 0.01 | 5.0 | Dissolved remaining some shape |

| | Physical properties prior to the heat-treatment | | Physical properties subsequent to the heat-treatment at 200° C. for 20 seconds | | | | | | | | |
|---|---|---|---|---|---|---|---|---|---|---|---|
| | Ratio of the wet to the dry strength % | | Dried (D') | | After soaking in water at 20° C. for 16 hours (W1) | | After boiling in water at 100° C. for 5 minutes (W'2) | | | Ratio of the wet to the dry strength (%) | |
| | 100 W1/D | 100 W2/D | Strength (kg/15mm width) | Elongation (%) | Strength (kg/15mm width) | Elongation (%) | Strength (kg/15mm width) | Elongation (%) | Retention of paper shape | 100 W'1/D' | 100 W'2/D' |
| Sheet of this invention | 29 | — | 4.43 | 2.9 | 1.78 | 8.7 | 1.31 | 8.6 | No change | 40 | 30 |
| Sheet for comparative example | 26 | — | 4.32 | 2.9 | 1.47 | 7.9 | 0.26 | 2.5 | Nap fibers dispersed | 34 | 6 |
| Sheet of this invention | 6 | 3 | 0.32 | 1.5 | 0.13 | 3.0 | 0.11 | 4.2 | No change | 41 | 34 |
| Sheet for comparative example | 7 | 3 | 0.31 | 1.6 | 0.10 | 3.1 | 0.01 | 4.0 | Nap fibers dispersed | 32 | 3 |

EXAMPLE 3

An aqueous solution was prepared by dissolving the same PVA as used in Example 1 and Kymene 557H (the trade name of watersoluble cationic polyamide-1-halogen-2,3-epoxypropane resin produced by Dic-Hercules Chemicals, Inc.) in water. The amount of Kymene 557H was 20 percent by weight of the amount of the PVA, and the PVA concentration was adjusted to 16 percent by weight based on the total weight of the aqueous solution. Mixing was well carried out without separation of the components. The pH of this solution was adjusted with sulfuric acid to 5.5. The solution was quite stable without causing viscosity change or gelation when allowed to stand at 90° C. for 16 hours. The PVA binding fiber was produced by spinning the solution into the coagulating bath in the form of filaments and cutting the filaments 3 mm long in accordance with Example 1. The dissolving temperature was 84° C.

A polyester fiber of 1.5 denier cut 5 mm long was used as a paper stock fiber, with which the above PVA binding fiber was blended in the ratio of 2 to 8. Paper-making and heat-treatment were carried out in the same way as described in Example 1.

Physical properties of the paper are detailed in Table 5.

TABLE 5

| | Physical properties prior to the heat-treatment | | | | | | | | |
|---|---|---|---|---|---|---|---|---|---|
| | Dried (D) | | After soaking in water at 20° C. for 16 hours ($W_1$) | | After boiing in water at 100° C. for 5 minutes ($W_2$) | | | Ratio of the wet to the dry strength (= (the wet strength/ the dry strength) × 100) | |
| Weight per unit area g/m² | Strength kg/ 15mm width | Elongation % | Strength kg/ 15mm width | Elongation % | Strength kg/ 15mm width | Elongation % | Retention of paper shape | $100W_1/D$ | $100W_2/D$ |
| 60.5 | 2.00 | 1.8 | 0.04 | 4.0 | — | — | no shape (remained) | 2 | — |
| | Physical properties subsequent to the heat-treatment at 200° C. for 20 seconds | | | | | | | | |
| | Dried (D') | | After soaking in water at 20° C. for 16 hours ($W'_1$) | | After boiling in water at 100° C. for 5 minutes ($W'_2$) | | | Ratio of the wet to the dry strength (= (the wet strength/ the dry strength) × 100) | |
| Weight per unit area g/m² | Strength kg/ 15mm width | Elongation % | Strength kg/ 15mm width | Elongation % | Strength kg/ 15mm width | Elongation % | Retention of paper shape | $100W'_1/D'$ | $100W'_2/D'$ |
| 60.5 | 2.3 | 1.7 | 0.70 | 4.5 | 0.58 | 4.0 | no change | 30 | 25 |

EXAMPLE 4

PVA having a degree of polymerization of 1700 and a complete degree of saponification of 99.9 mole percent was rinsed well with water and PVA chips at 48 percent concentration was obtained. Polyfix 301 (the trade name of polyamide-1-chloro-2,3-epoxy propane resin produced by Showa Highpolymer Co., Ltd.) was added to the PVA chips so as to reach a concentration of 20 percent by weight based on the weight of the PVA, and the mixture was agitated in a ribbon mixer equipped with a heating jacket. The jacket temperature was kept at 80° C. in order to increase mixing of the PVA chips gradually, and by adding an amount of water the PVA concentration was adjusted to 38 percent by weight, then the PVA became a chip-like object. This PVA chip, by means of an extruder with a 2-inch diameter screw, was subjected to spinning at 110° C. The filament extruded in the air through 0.1 mm spinnerets was solidified to a 20 denier fineness. The dissolving temperature being 78° C., this filament was cut 3 mm long to serve as the binding fiber. Rayon PB 1505 (the trade name of a papermaking rayon produced by Daiwa Spinning Co., Ltd.) was used as a paper stock fiber with which the above PVA fiber was blended in the ratio of 1 to 9. TAPPI's square-shaped standard paper-making machine was used for paper-making, then the sheet was dried. The dried sheet was dissolved in water at 100° C., but the sheet having undergone the heat-treatment at 190° C. for 60 seconds could maintain the shape after boiling and could be handled with ease.

EXAMPLE 5

An aqueous solution was prepared by dissolving the same PVA as used in Example 1 and Denacol EX-810 (the trade name of ethylene glycol diglycidyl ether produced by Nagase & Co., Ltd.) in water. The amount of Denacol EX-810 was made 10 percent by weight of the amount of the PVA and the PVA concentration was adjusted to 16 percent by weight based on the total weight of the aqueous solution. Mixing was carried out without causing separation of the components. The solution after mixing was found to be stable, because viscosity change and gelation did not occur when the solution was allowed to stand at 90° C. The pH also did not shown almost any change. Filaments obtained from the wet spinning were cut to 3 mm short fiber and were employed as the binding fiber. Seeing that the dissolving temperature measured 85° C., the binding fiber proved to be useful. Fiberglass with 10 microns diameter and 13 mm length, which was made for paper-making, was used as paper stock fiber. The mixing ratio of the PVA binding fiber to the fiberglass was made 2:8. The conditions of paper-making and heat-treatment were the same as described in Example 1. The physical properties of this fiberglass paper are shown in Table 6.

TABLE 6

| | Physical properties prior to the heat-treatment | | | | | | | | |
|---|---|---|---|---|---|---|---|---|---|
| | Dried (D) | | After soaking in water at 20° C. for 16 hours ($W_1$) | | After boiling in water at 100° C. for 5 minutes ($W_2$) | | | Ratio of the wet to the dry Strength (= (the wet strength/ the dry strength) × 100) | |
| Weight per unit area | Strength kg/ | Elongation | Strength kg/ | Elongation | Strength kg/ | Elongation | Retention of paper | $100W_1/$ | $100W_2/$ |

TABLE 6-continued

| g/m² | 15mm width | % | 15mm width | % | 15mm width | % | shape | D | D |
|---|---|---|---|---|---|---|---|---|---|
| 63.0 | 1.10 | 1.2 | 0.01 | 2 | — | — | dissolved remaining no shape | 1 | — |

| | Physical properties subsequent to the heat-treatment at 200° C. for 20 seconds | | | | | | | | |
|---|---|---|---|---|---|---|---|---|---|
| | Dried (D') | | After soaking in water at 20° C. for 16 hours ($W'_1$) | | After boiling in water at 100° C. for 5 minutes ($W_2$) | | | Ratio of the wet to the dry strength (= (the wet strength/ the dry strength) × 100) | |
| Weight per unit area g/m² | Strength kg/ 15mm width | Elongation % | Strength kg/ 15mm width | Elongation % | Strength kg/ 15mm width | Elongation % | Retention of paper shape | $100W'_1/D'$ | $100W'_2/D'$ |
| 63.0 | 13.2 | 1.0 | 0.6 | 3 | 0.40 | 3 | no change | 45 | 30 |

As shown in Table 6, the strength of the fiberglass paper was as low as 10 grams and could not stand boiling prior to heat-treatment. But by virtue of heat-treatment, lowering of the strength due to soaking in water was prevented and the shape was retained after boiling. Moreover, the ratio of the wet to the dry strength was found to be more than 30 percent and the paper was converted into a boiling water resistant material.

What is claimed is:

1. A fibrous sheet exhibiting enhanced wet strength comprising a dispersion of paper stock fibers and from 2 to 30 percent by weight of polyvinyl alcohol fibers, said polyvinyl alcohol fiber comprising a water-soluble polyvinyl alcohol fiber containing from 5 to 50 percent by weight of an adduct comprising a polyamide condensation product and a 1-halogen-2,3-epoxy propane or ethylene glycol diglycidyl ether, said fiber, when not having been heat treated at a temperature about 120° C., possesses the latent ability of becoming boiling-water resistant upon being heat treated at a temperature above 120° C., said sheet having been heat treated at a temperature above 120° C.

2. The sheet of claim 1 wherein the adduct is present in an amount of from 20 to 30 by weight of the polyvinyl alcohol fiber.

3. The sheet of claim 1 wherein the polyvinyl alcohol fiber has a degree of saponification of the polyvinyl alcohol ranges from 80 to 100 mole percent.

4. The sheet of claim 1 wherein the degree of polymerization of the polyvinyl alcohol fiber ranges from 300 to 3000.

5. The sheet of claim 1 wherein the polyvinyl alcohol fiber exhibits a dissolving temperature which ranges between 45° and 95° C.

6. A process for producing fibrous sheet exhibiting enhanced wet strength comprising forming a slurry of paper stock fibers and from 2 to 30 percent by weight of polyvinyl alcohol fibers, forming a sheet from said slurry and drying said sheet at an elevated temperature said polyvinyl alcohol fibers possessing the latent ability of becoming boiling water-resistant upon heat treatment at a temperature above 120° C. and are formed by a process which comprises forming a solution by admixing a 5 to 70 percent by weight aqueous solution of polyvinyl alcohol with from 5 to 50 percent by weight based upon the weight of polyvinyl alcohol of an adduct of a polyamide condensation product and a 1-halogen-2,3-epoxy propane or ethylene glycol diglycidyl ether; adjusting the pH of the solution to from 2 to 7 and forming fibers from said solution by dry or wet spinning.

7. A process as defined in claim 6 wherein from 20 to 30 percent by weight of said adduct is admixed with the polyvinyl alcohol solution.

8. A process as defined in claim 6 wherein the sheet is heat treated at a temperature below 120° C.

9. A process as defined in claim 6 wherein the sheet is heat treated at a temperature above 120° C. for 1 to 120 seconds.

10. A process as defined in claim 6 wherein the sheet is heat treated at a temperature above 120° C.

* * * * *